US005140639A

United States Patent [19]

Sprague et al.

[11] Patent Number: 5,140,639

[45] Date of Patent: Aug. 18, 1992

[54] SPEECH GENERATION USING VARIABLE FREQUENCY OSCILLATORS

[75] Inventors: Richard P. Sprague, El Toro; William J. Arthur, Capistrano Beach, both of Calif.

[73] Assignee: First Byte, Torrance, Calif.

[21] Appl. No.: 566,965

[22] Filed: Aug. 13, 1990

[51] Int. Cl.[5] ..... G10L 7/06; G10L 5/02

[52] U.S. Cl. ..... 381/51

[58] Field of Search ..... 381/51-53, 381/36, 49

[56] References Cited

U.S. PATENT DOCUMENTS

| | | | |
|---|---|---|---|
| 3,668,294 | 6/1972 | Kameoka et al. | 381/51 |
| 3,830,977 | 8/1974 | Dechaux | 381/51 |
| 3,974,334 | 8/1976 | Cockerell | 381/51 |
| 3,995,116 | 11/1976 | Flanagan | 381/51 |
| 4,360,708 | 11/1982 | Taguchi et al. | 381/36 |
| 4,584,922 | 4/1986 | Kamiya | 381/51 |
| 4,624,012 | 11/1986 | Lin et al. | 381/51 |

OTHER PUBLICATIONS

Flanagan, Speech Analysis Synthesis and Perception, Second Edition, pp. 212-214, New York 1972 by Springer Verlag.

*Primary Examiner*—Dale M. Shaw
*Assistant Examiner*—David D. Knepper
*Attorney, Agent, or Firm*—Weissenberger, Peterson, Uxa & Myers

[57] ABSTRACT

Artificial speech is produced with minimized memory requirements by using a bank of digital oscillators to produce voiced sounds by combining multiple harmonies of a fundamental-frequency sine wave, and using only one of these oscillators to reproduce stored nonsinusoidal waveforms for unvoiced sounds. Sufficient dynamic range is achieved with a minimum number of oscillators by generating only every other harmonic at the higher frequencies. All harmonics are derived from a single stored digitized sine wave by using stored sets of skip counts and amplitude codes corresponding to various voiced sounds to be produced.

6 Claims, 4 Drawing Sheets

SPEECH GENERATION USING VARIABLE FREQUENCY OSCILLATORS

FIELD OF THE INVENTION

This invention relates to the generation of artificial speech in computers, and more particularly to a method of generating speech sounds by additively combining the outputs of a plurality of digital variable-frequency oscillators.

BACKGROUND OF THE INVENTION

The ability of personal computers to generate high-quality musical sounds has assumed increasing importance in recent years. For this purpose, some manufacturers have equipped their personal computers with a set of variable frequency digital oscillators which repetitively sample one or more waveform buffers. Each oscillator reads out (at a fixed clock rate) every sample, every other sample, every third sample, etc. to produce a base frequency sound, its second harmonic, its third harmonic, etc. respectively. The amplitude of each oscillator's output can be varied by digital or analog means.

By adding the outputs of a plurality (e.g. 32) of these oscillators, it is possible to produce a 32-term Fourier series which can adequately define even a fairly complex musical waveform over a time interval corresponding to one cycle of the base frequency. This method is known as additive synthesis.

Theoretically, the above-described system can also generate speech, particularly the voiced parts of speech whose waveforms are structurally similar to music. In practice, however, speech generated by this method is flawed for two reasons: firstly, a straight Fourier expansion does not provide sufficient dynamic range for speech generation; and secondly, a Fourier expansion is not usable with unvoiced sounds because unvoiced sounds have no fundamental frequency.

SUMMARY OF THE INVENTION

The present invention makes it possible to use the additive synthesis capability of personal computers to generate speech with a sharply reduced expenditure of memory as opposed to conventional methods of speech generation.

In accordance with the invention, dynamic range is increased by dividing the oscillator set into a plurality of groups, and setting their frequencies and summing their outputs to provide a summed output having the general form of $$s = \sum_{i=1}^{n/m} a_i \sin ix + \sum_{i=(n/m)+1}^{2n/m} a_i \sin(2(i - n/m) + n/m)x = + \ldots + \sum_{i=((m-1)n/m)+1}^{n} a_i \sin(m(i - n(m-1)/m) + n(1 = 2 + \ldots + m - 1)/m)x$$

where a is the amplitude of an individual oscillator's output, x is the fundamental frequency, i is the oscillator number, n is the total number of oscillators, and m is the number of oscillator groups (assuming each group contains the same number of oscillators).

Unvoiced sounds are accommodated in the invention by disabling the output of all but one of the oscillators and substituting the waveform of the unvoiced sound for the fundamental-frequency sine wave.

DESCRIPTION OF THE PREFERRED EMBODIMENT

Figure 1:
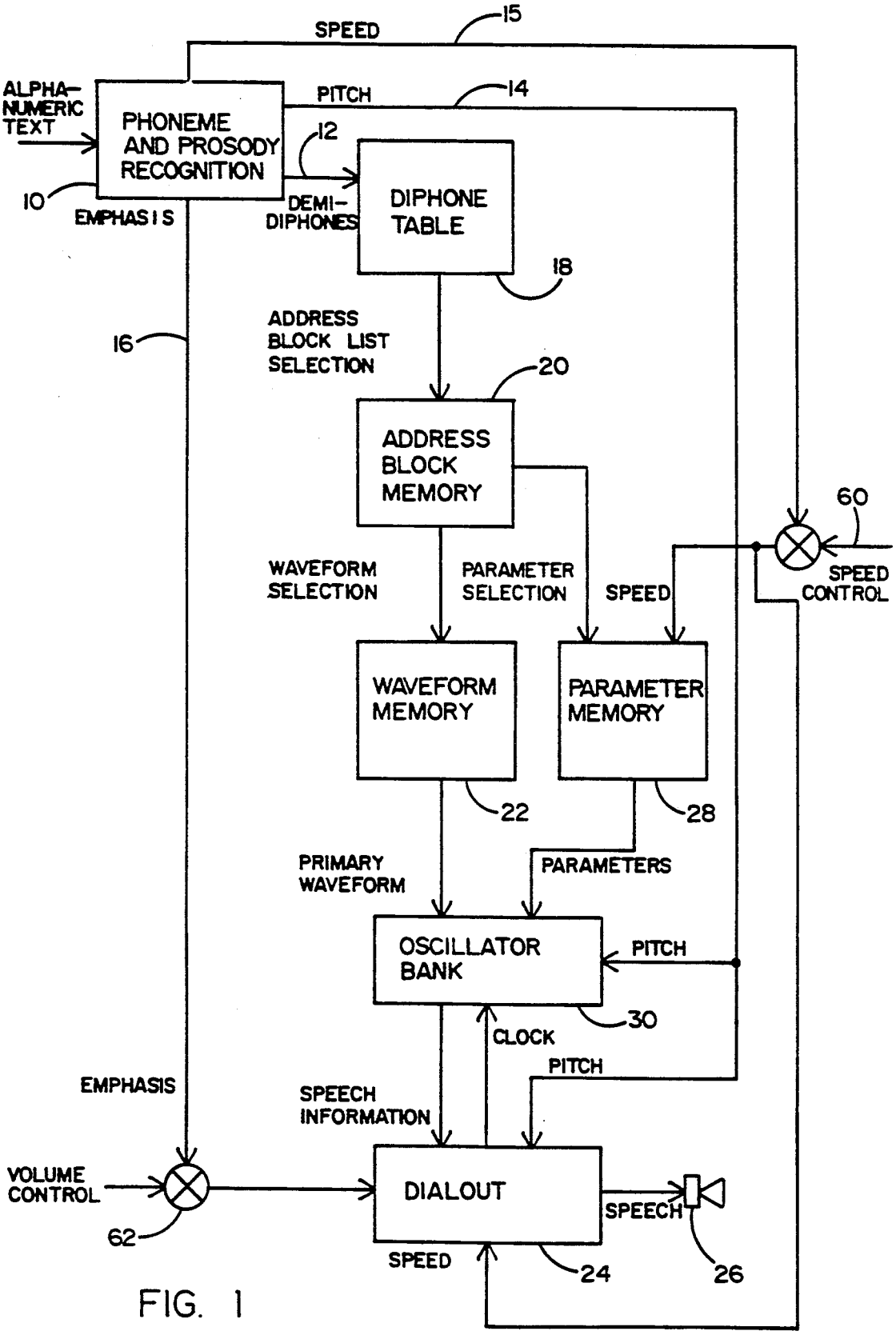
FIG. 1 is a block diagram of a speech-generating system using the invention.

As shown in FIG. 1, the speech generation apparatus of this invention may typically be used in a text-to-speech conversion system of an otherwise conventional type. In such a system, alphanumeric text may be analyzed at 10 to recognize phonemes and prosody information. The phoneme information may be encoded into demi-diphone codes 12 while pitch, speed, and emphasis information associated with each demi-diphone is encoded into pitch, speed, and emphasis signals 14, 15 and 16, respectively.

The diphone table 18 is stored in memory selects, for each demi-diphone, a sequence of address blocks from an address block memory 20. In a conventional text-to-speech conversion system, each address block calls up a digitized waveform from the waveform memory 22 and supplies all or part of it to an appropriate dialout program 24 which processes the waveform data, modifies it in response to the pitch, speed and emphasis signals 14, 15, 16, and feeds it to a loudspeaker 26.

In the system of the invention, the above-described conventional system is modified by the addition of a parameter memory 28 and an oscillator bank 30. Instead of selecting a separate appropriate waveform for each address block of each demi-diphone and feeding it directly to the dialout circuitry 24, the inventive system selects, for each address block, a primary waveform (which, for voiced sounds, is simply a sine wave) and a set of control parameters which control the oscillator bank 30 in a manner now to be described.

Figure 2:
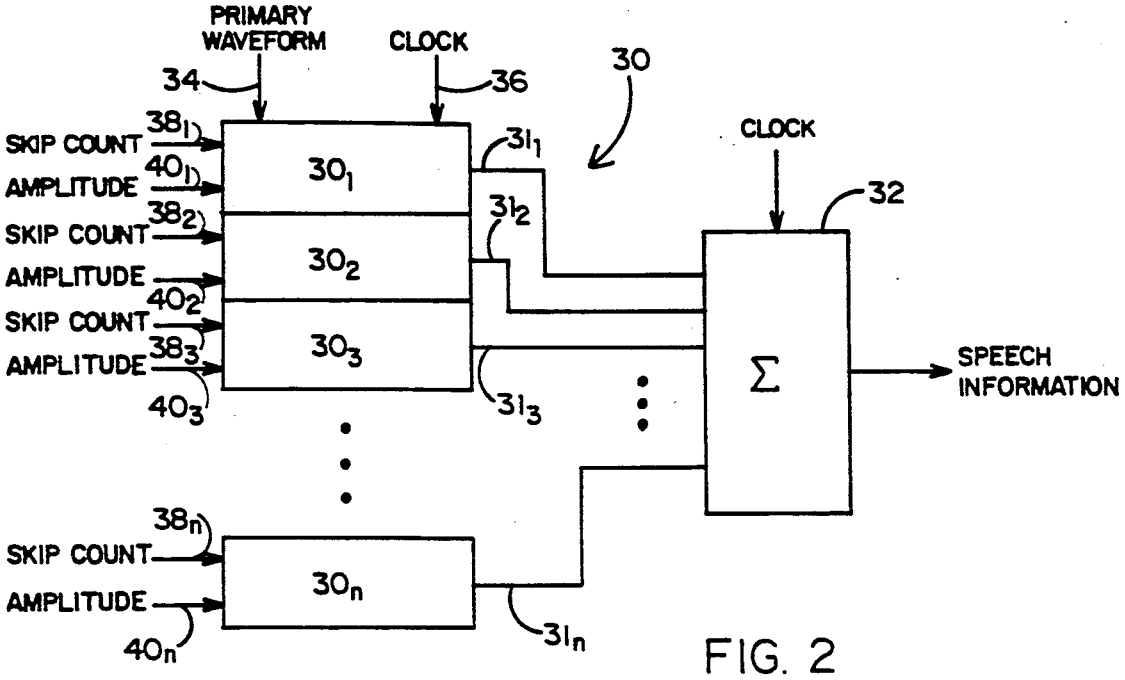
FIG. 2 is a block diagram of the oscillator bank.

As shown in FIG. 2, the oscillator bank 30 consists of a set of digital oscillators $\mathbf{30}_1$ through $\mathbf{30}_n$. In the preferred embodiment, n is thirty-two. The outputs $\mathbf{31}_1$ through $\mathbf{31}_n$ of the oscillators $\mathbf{30}_1$ through $\mathbf{30}_n$ are combined in an adder 32. The output of adder 32 is the speech information supplied to the dialout circuitry 24. The primary waveform 34 selected from the waveform memory 22 by a given address block is applied equally to all the oscillators, as is the clock 36 supplied by the dialout circuitry 24. Each oscillator $\mathbf{30}_l$ through $\mathbf{30}_n$, however, receives its own individual skip count $\mathbf{38}_1$ through $\mathbf{38}_n$ and amplitude code $\mathbf{40}_1$ through $\mathbf{40}_n$, respectively, from the parameter memory 28.

Figure 3:
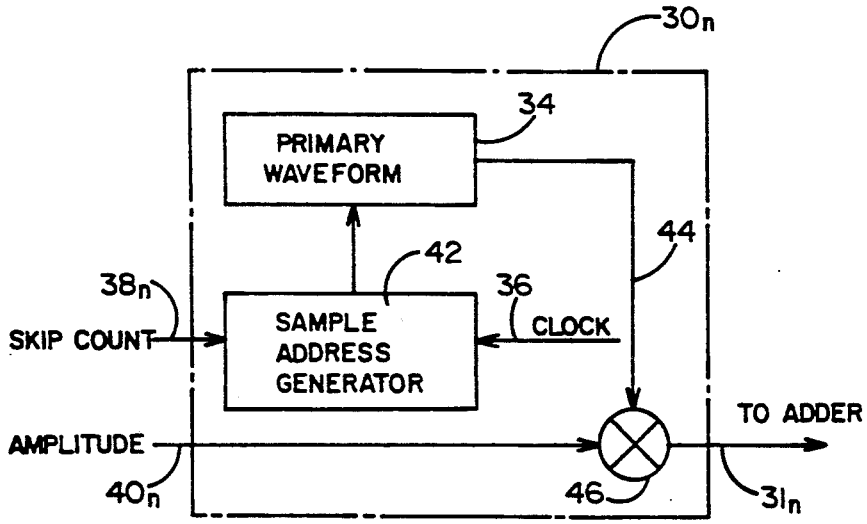
FIG. 3 is a block diagram of an oscillator.

The operation of an individual oscillator such as $\mathbf{30}_n$ is illustrated in FIG. 3. The skip count $\mathbf{38}_n$ is applied to a sample address generator 42 which, in response to the skip count $\mathbf{38}_n$, outputs on successive clock pulses 36 every j-th sample of the digitized primary waveform 34 or repeats each sample times. The outputted samples 44 are multiplied in a multiplier 46 by the amplitude code $\mathbf{40}_n$ to form the oscillator output $\mathbf{31}_n$.

Figure 4:
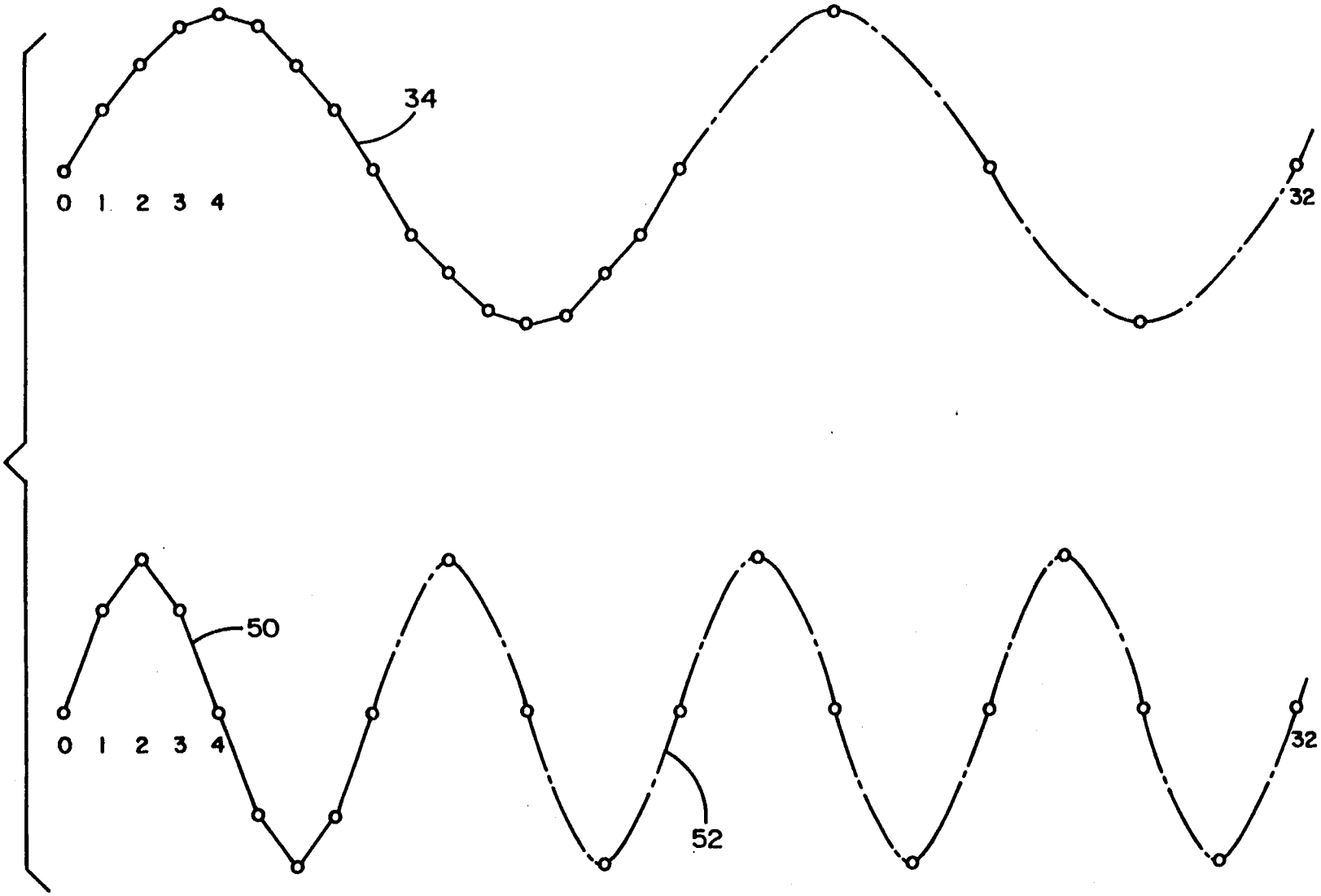
FIG. 4 is a time-amplitude diagram illustrating the upsampling of a primary sine wave.
Figure 5:
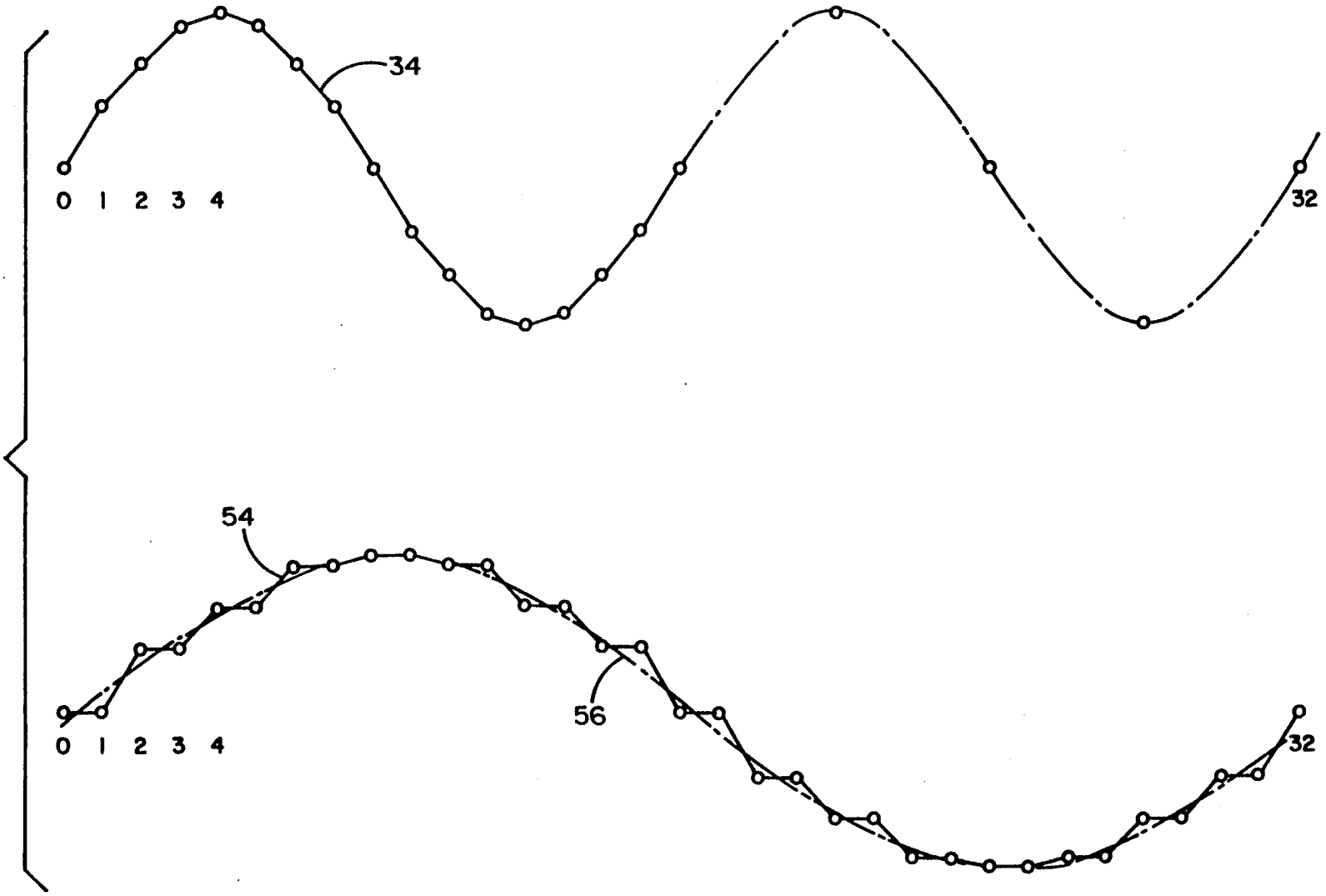
FIG. 5 is a time-amplitude diagram illustrating downsampling of the same primary sine wave.

FIGS. 4 and 5 show how size waves of various frequencies are produced from a sinusoidal primary waveform 34 by varying the skip count 38 (FIG. 2). In FIG. 4, setting the skip count 38 so as to cause sample address generator 42 to read every other sample (i.e. j=2) of the primary waveform 34 (upper curve) produces the lower curve 50 in which sample 1 equals sample 2 of curve 34, sample 2 equals sample 4 of curve 34, etc. The filtering action of the dialout circuitry 24 smoothes curve 50 to form the sinusoidal output curve 52 which has exactly twice the frequency of the primary waveform 34.

Likewise, in FIG. 5, setting the skip count 38 so as to cause sample address generator 42 to read every sample of primary waveform 34 twice (i.e. k=2) produces the lower curve 54 which is smoothed by the dialout circuitry 24 to form the sinusoidal curve 56 of exactly one-half the frequency of primary waveform 34. Alternating the value of j in FIG. 4 or of k in FIG. 5 on successive samples can produce any desired frequency ratio.

The operation of the inventive system is as follows: For voiced sounds, the primary waveform is a sine wave which can be any harmonic of a desired fundamental frequency. The fundamental frequency is determined by the performance requirements of a given system, and the primary waveform, in practice, is preferably the highest harmonic used in the system because it is easier to repetitively address samples than to skip them.

In programming the system of this invention, the length and fundamental frequency of the voiced-sound sine wave are best selected to produce maximum linearity in the response. Any residual nonlinearity of the output may be compensated by appropriately inverting the input, i.e. distoring the theoretical sine wave coefficients and frequencies.

Suitable oscillator chips with thirty-two oscillators are readily available. However, the reproduction of speech, unlike that of music, by a Fourier series approach with multiple oscillators requires a very large dynamic range. For this reason the reproduction of speech sounds cannot be satisfactorily accomplished with thirty-two oscillators generating the first thirty-two harmonics of a desired sound. The invention recognizes that speech sounds can be adequately reproduced by a Fourier series which includes every harmonic in a low range, and less than every harmonic in a higher range, essentially according to the generalized expression $$s = \sum_{i=1}^{n/m} a_i \sin ix + \sum_{i=(n/m)+1}^{2n/m} a_i \sin(2(i - n/m) + n/m)x = + \ldots + \sum_{i=((m-1)n/m)+1}^{n} a_i \sin(m(i - n(m-1)/m) + n(1 = 2 + \ldots + m - 1)/m)x$$

In practice, with thirty-two oscillators arranged in two groups (n=32, m=2), the first sixteen oscillators $30_1$ through $30_{16}$ produce the first sixteen harmonics of the fundamental frequency, and the second sixteen oscillators $30_{17}$ through $30_{32}$ produce every even harmonic from the eighteenth through the forty-eighth, for a series in the form $$s = \sum_{i=1}^{16} a_i \sin ix + \sum_{i=17}^{32} a_i \sin(2i - 16)x$$

where i is the oscillator number and x is the fundamental frequency. By assigning an appropriate amplitude code 40 as a multiplier to each oscillator, any voiced speech sound can be satisfactorily generated.

Speech, unlike music, also has another problem: unvoiced sounds cannot be usefully constructed from a thirty-two term Fourier series. The invention solves this problem by selecting, for unvoiced sounds, actual stored waveforms representing the desired sound. The selected waveform is applied as the primary waveform to all the oscillators $30_1$ through $30_n$, but the amplitude multipliers $40_2$ through $40_n$ are all set to zero while the skip count of oscillator $30_1$ is set to read each sample once. Consequently, the output of adder 32 is the selected waveform.

In order to prevent an ear-detectable switching beat, the parameters applied to the oscillators $30_1$ through $30_n$ are preferably updated not simultaneously, but rather one by one on an oscillator-to-oscillator basis while the oscillators are running.

Speed variations are accomplished by repeating or skipping address blocks in an address block sequence called up from the address block memory 20. Although speed variations within a text are determined by the speed signal 15 generated as a function of prosody, a user-selectable overall speed control 60 (FIG. 1) may be provided.

Emphasis variations are accommodated by varying the overall scaling of the speech information supplied to the dialout circuitry 24. Although emphasis variations within a text are determined, as a function of prosody, by the emphsis signal 16, a user-selectable volume control 62 (FIG. 1) would normally also be provided.

We claim:

1. A speech generation system, comprising:

a) means for producing indicia identifying voiced and unvoiced speech elements to be produced;

b) a plurality of digital oscillators;

c) means for combining the outputs of said oscillators to produce speech information;

d) means connected to said combined oscillator outputs for converting said speech information into audible speech sounds;

e) a waveform memory for storing, for each of said voiced speech elements, a common sinusoidal waveform and for storing individual speech element waveforms for unvoiced speech elements;

f) a parameter memory for storing sets of oscillator operating parameters associated with individual voiced speech elements;

g) said waveform memory and parameter memory being connected to said oscillators; and h) means for operating said oscillators so as to produce outputs representative of a selected one of said waveforms, as modified by selected ones of said parameters, the selection being responsive to said speech element identifying indicia.

2. The system of claim 1, in which said parameters are skip count and amplitude.

3. The system of claim 1, in which said oscillators output harmonics of a fundamental frequency derived from said stored common sinusoidal waveform for voiced speech elements, and one of said oscillators outputs selected ones of said individual speech element waveforms for unvoiced speech elements.

4. The system of claim 3, in which said oscillators are divided into groups, each group producing every p-th harmonic in a group of harmonics of said fundamental frequency, p being an integer having different values for different groups.

5. The system of claim 4, in which there are substantially thirtytwo oscillators, substantially the first sixteen producing substantially the first sixteen harmonics of said fundamental frequency, and substantially the second sixteen producing substantially every second harmonic above the sixteenth.

6. A method of producing artificial speech sounds, comprising the steps of:

a) simultaneously producing from a common stored sinusoidal waveform associated with a specific voiced speech sound a plurality of sine waves, each being a harmonic of the lowest-frequency since wave being produced, and combining said sine waves to form said voiced speech sound;

b) producing single speech sound waveforms to form unvoiced speech sounds; and c) concatenating said voiced and unvoiced speech sounds to form speech.

* * * * *